US007614923B2

(12) United States Patent
De France

(10) Patent No.: US 7,614,923 B2
(45) Date of Patent: Nov. 10, 2009

(54) CONDUCTOR CONNECTION

(75) Inventor: Robert V. De France, Poughkeepsie, NY (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 12/319,607

(22) Filed: Jan. 8, 2009

(65) Prior Publication Data

US 2009/0130872 A1 May 21, 2009

Related U.S. Application Data

(63) Continuation of application No. 11/778,777, filed on Jul. 17, 2007, now Pat. No. 7,485,014.

(60) Provisional application No. 60/833,642, filed on Jul. 26, 2006, provisional application No. 60/904,080, filed on Feb. 28, 2007.

(51) Int. Cl.
*H01R 4/30* (2006.01)

(52) U.S. Cl. ..... 439/803

(58) Field of Classification Search ..... 439/803, 439/801, 479; 24/135 R, 135 K; 174/169, 174/168; 248/74.4
See application file for complete search history.

(56) References Cited

U.S. PATENT DOCUMENTS

| | | | | |
|---|---|---|---|---|
| 1,172,604 | A | 2/1916 | Johnson, Jr. | |
| 1,964,511 | A | 6/1934 | Grover | 173/273 |
| 2,096,796 | A | 10/1937 | Dunaway | 173/273 |
| 2,234,022 | A | 3/1941 | Churchill | 173/273 |
| 2,811,703 | A | 10/1957 | Becker | 439/803 |
| 2,958,067 | A | 10/1960 | Hardy | 339/109 |
| 2,986,721 | A | 5/1961 | Conright | 339/109 |
| 3,065,449 | A | 11/1962 | Matthysse et al. | 339/247 |
| 3,075,166 | A | 1/1963 | Peek | 339/109 |
| 3,097,037 | A | 7/1963 | Gainer et al. | 339/245 |
| 3,437,742 | A | 4/1969 | Lindsey | 174/169 |
| 3,614,700 | A | 10/1971 | Beard et al. | 337/203 |
| 3,621,160 | A | 11/1971 | Turner et al. | 200/48 |
| 3,629,805 | A | 12/1971 | Peek | 339/109 |
| 3,836,102 | A | 9/1974 | Hall | 248/74 R |
| 4,097,108 | A | 6/1978 | Prodel | 439/475 |
| 4,105,272 | A | 8/1978 | West et al. | 339/14 L |
| 4,415,222 | A | 11/1983 | Polidori | 339/270 R |
| 4,846,725 | A | 7/1989 | Williams et al. | 439/479 |
| 5,029,797 | A | 7/1991 | Levorchick et al. | 248/459 |
| 5,397,982 | A | 3/1995 | Van Lankvelt | 324/126 |
| 5,423,699 | A | 6/1995 | Johnson | 439/783 |

(Continued)

OTHER PUBLICATIONS

Grounding Equipment brochure, Jan. 2007, Section 3000-3028, Hubbell Power Systems, Inc., Chance.

*Primary Examiner*—Phuong K Dinh
(74) *Attorney, Agent, or Firm*—Harrington & Smith, PC

(57) ABSTRACT

Disclosed herein is a grounding connector. The grounding connector includes a female member, a male member, and a threaded member. The female member includes a first clamp section, a conductor connection section, and a center section between the first clamp section and the conductor connection section. The center section includes a first opening. The male member includes a barrel section, a second clamp section, and a web section between the barrel section and the second clamp section. The barrel section includes a threaded opening. The threaded member extends through the first opening. The threaded member is engaged with the threaded opening.

20 Claims, 10 Drawing Sheets

U.S. PATENT DOCUMENTS 5,547,404 A * 8/1996 Nellis et al. ..... 439/803
5,556,299 A * 9/1996 Finke ..... 439/479
5,581,051 A 12/1996 Hill ..... 174/138 R
6,448,503 B1 9/2002 McKinnon et al. ..... 174/146
6,713,679 B2 3/2004 Roberts ..... 174/135
2002/0177353 A1 11/2002 De France ..... 439/477

* cited by examiner

CONDUCTOR CONNECTION

CROSS REFERENCE TO RELATED APPLICATIONS

This is a continuation patent application of U.S. patent application Ser. No. 11/778,777 filed on Jul. 17, 2007 now U.S. Pat. No. 7,485,014. This application also claims priority under 35 U.S.C. §119(e) to U.S. provisional patent application No. 60/833,642 filed Jul. 26, 2006, and U.S. provisional patent application No. 60/904,080 filed Feb. 28, 2007, which are hereby incorporated by reference in their entireties.

BACKGROUND OF THE INVENTION

1. Field of the Invention

The invention relates to a conductor connection and, more particularly, to grounding connector.

2. Brief Description of Prior Developments

Often, a power supply unit has to be grounded out in order for the power utility lineperson to perform required work. All power supply units have some sort of doors that prevent anyone from coming in contact with the electrical supply. In order for a lineman to ground out a power supply, he has to open the door and install a grounding connector. U.S. Pat. No. 3,437,742, which is hereby incorporated by reference in its entirety, discloses a conductor clamping assembly. The existing design, when applied, does not allow the door to be closed. The connector actually protrudes beyond the opening of the door when it is installed. Therefore, when the existing connector is applied, and the doors are open, a lineperson has to be present at all times to prevent anyone from coming in contract with the energized unit. This can add up to be a very costly operation for the utility company.

Accordingly, there is a need to provide a grounding connector comprising an improved and robust configuration which facilitates installation within a power supply unit.

SUMMARY OF THE INVENTION

In accordance with one aspect of the invention, a grounding connector is disclosed. The grounding connector includes a female member, a male member, and a threaded member. The female member includes a first clamp section, a conductor connection section, and a center section between the first clamp section and the conductor connection section. The center section includes a first opening. The male member includes a barrel section, a second clamp section, and a web section between the barrel section and the second clamp section. The barrel section includes a threaded opening. The threaded member extends through the first opening. The threaded member is engaged with the threaded opening.

In accordance with another aspect of the invention, a grounding connector is disclosed. The grounding connector includes a female member, a male member, and a fastening member. The female member includes a generally "J" shaped clamp section, a conductor connection section, and a center section between the generally "J" shaped clamp section and the conductor connection section. The male member includes a second clamp section and a barrel section. The barrel section is aligned with the center section. The second clamp section is aligned with a portion of the generally "J" shaped clamp section. The fastening member includes a fastening end and a projecting end. The fastening end is fastened to the male member. The projecting end is adjacent the generally "J" shaped clamp section.

In accordance with yet another aspect of the invention, a method of manufacturing a grounding connector is disclosed. A female member comprising a first clamp section, a conductor connection section, and a center section between the first clamp section and the conductor connection section is provided. The center section includes a first opening. A male member comprising a barrel section, a second clamp section, and a web section between the barrel section and the second clamp section is provided. The barrel section includes a threaded opening. A threaded member is engaged with the threaded opening. The threaded member extends through the first opening.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
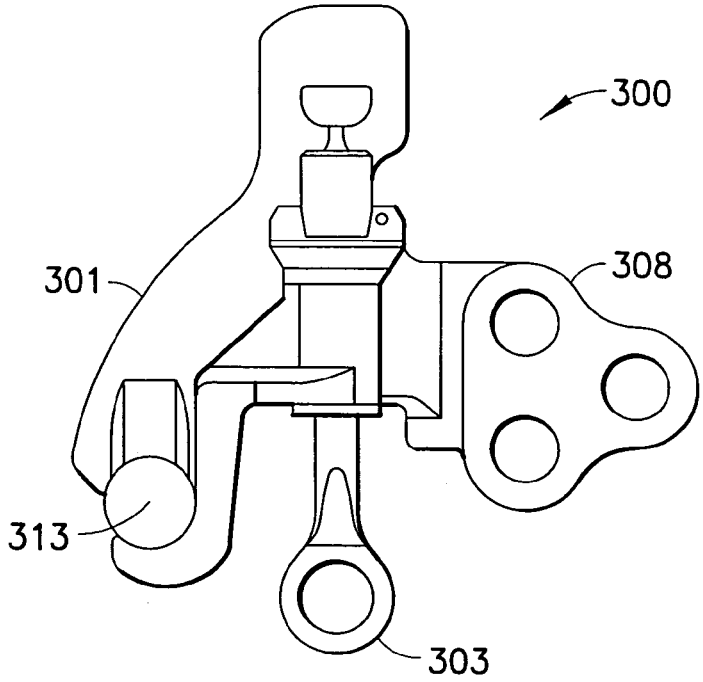
FIG. 1 is a left side view of an electrical connector incorporating features of the invention.
Figure 2:
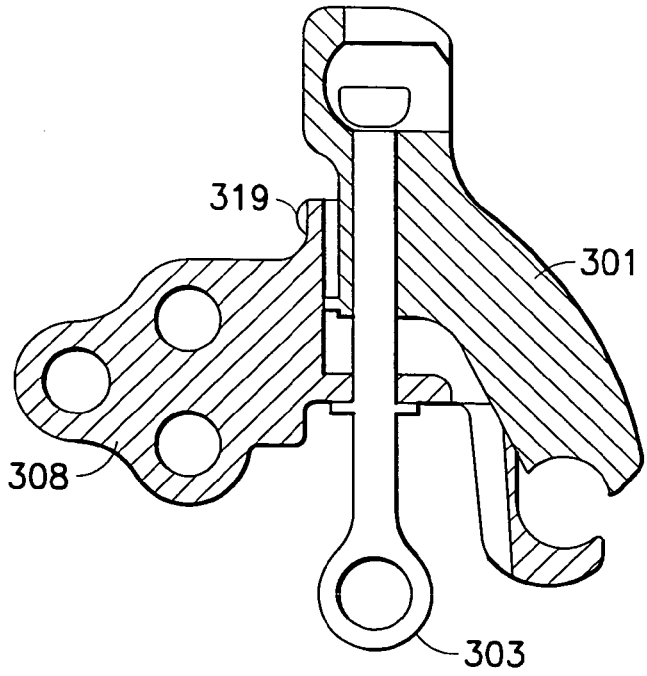
FIG. 2 a right side view of the electrical connector shown in FIG. 1.
Figure 3:
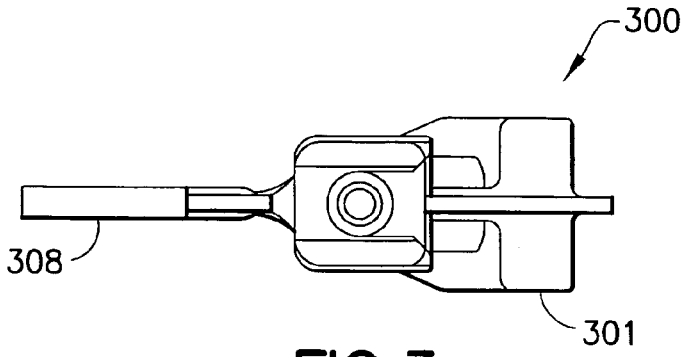
FIG. 3 is a top plan view of the electrical connector shown in FIG. 1.
Figure 4:
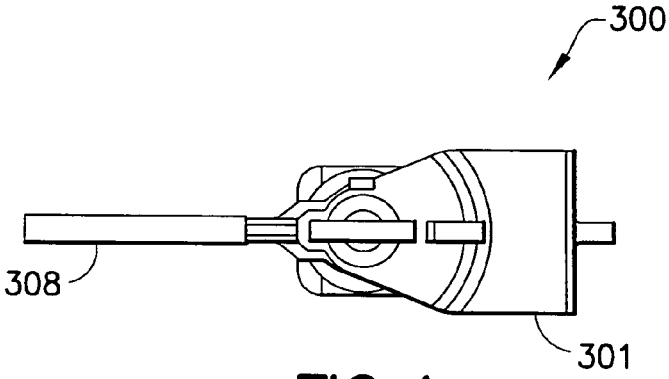
FIG. 4 is a bottom plan view of the electrical connector shown in FIG. 1.
Figure 5:
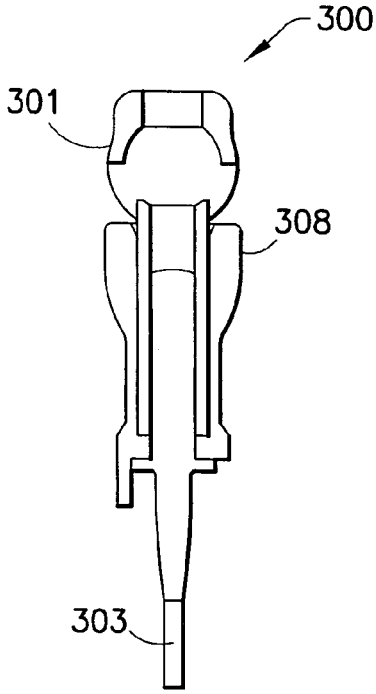
FIG. 5 is rear view of the electrical connector shown in FIG. 1.

Referring to FIG. 1, there is shown a side view of an electrical connector 300 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

Referring also to FIGS. 2-5, the connector 300 is a connector for grounding out an energized power supply unit. The connector 300 is designed so that, after it is installed, it does not interfere with the closing of the doors of the power supply. This was accomplished by moving the centerline of the grounding rod connection on the connector. The connector 300 generally comprises a male part 301, a female part 308 and an eyebolt 303.

Figure 6:
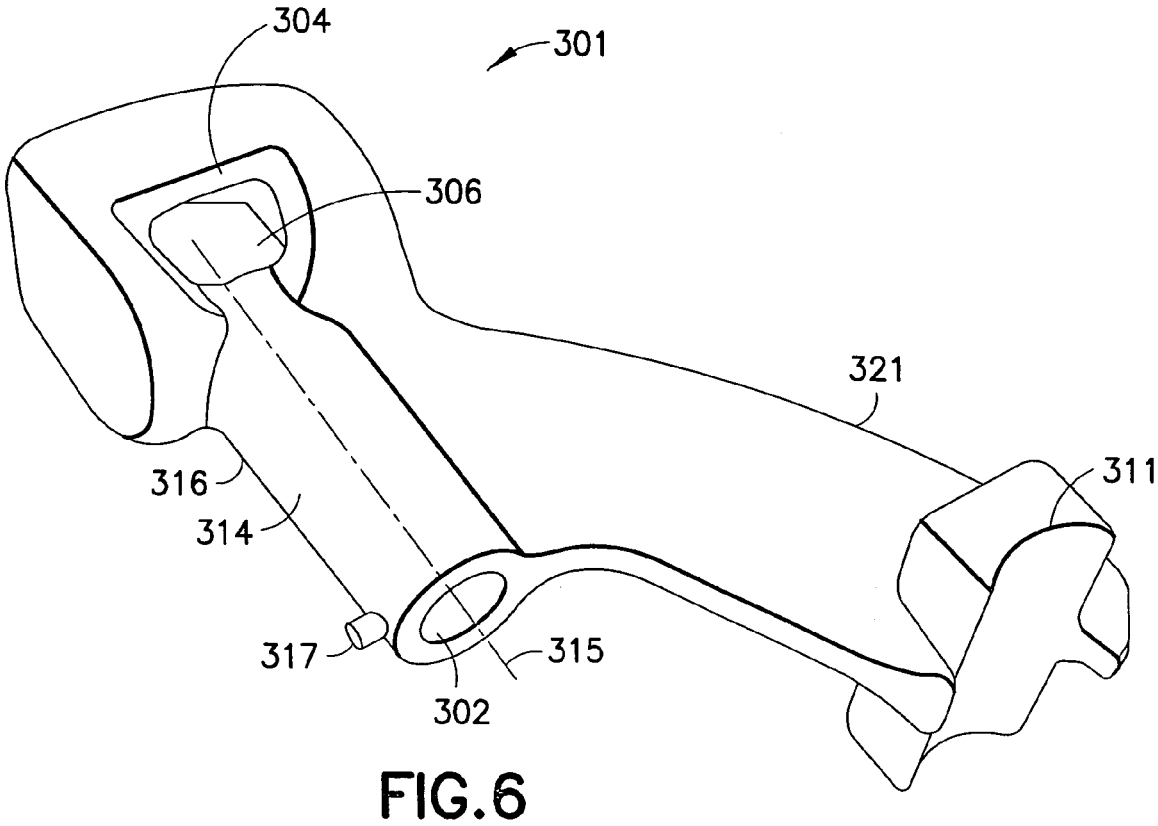
FIG. 6 is a perspective view of a male member of the electrical connector shown in FIG. 1.
Figure 7:
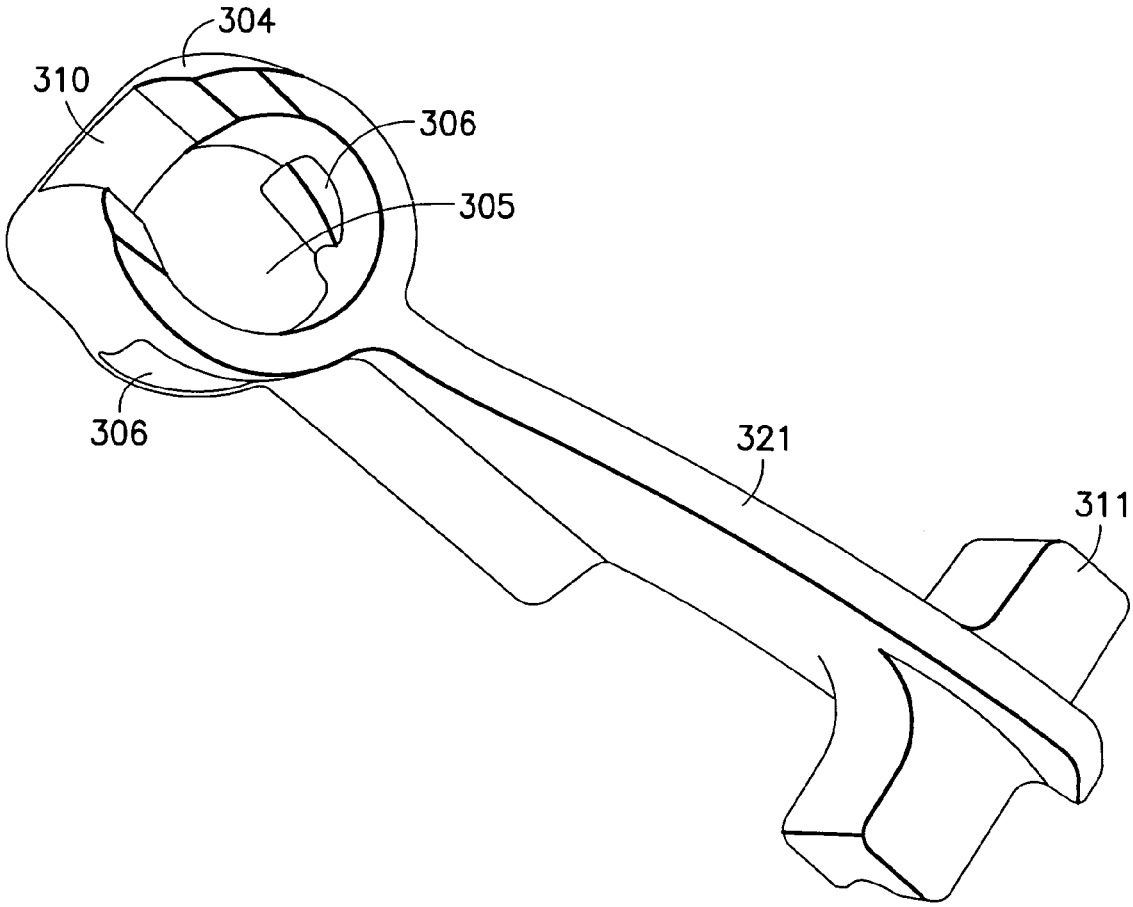
FIG. 7 is a perspective view of the male member of the electrical connector shown in FIG. 1.
Figure 8:
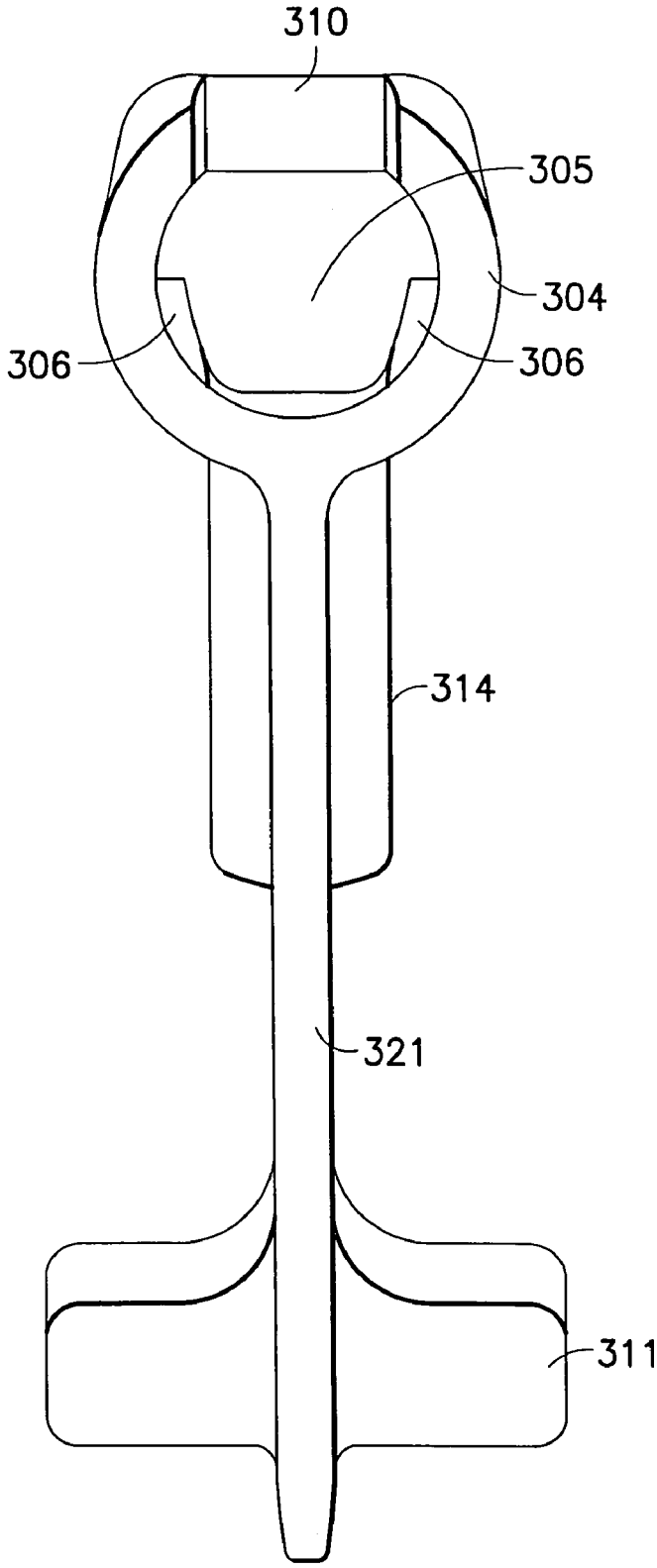
FIG. 8 is a rear view of the male member of the electrical connector shown in FIG. 1.
Figure 9:
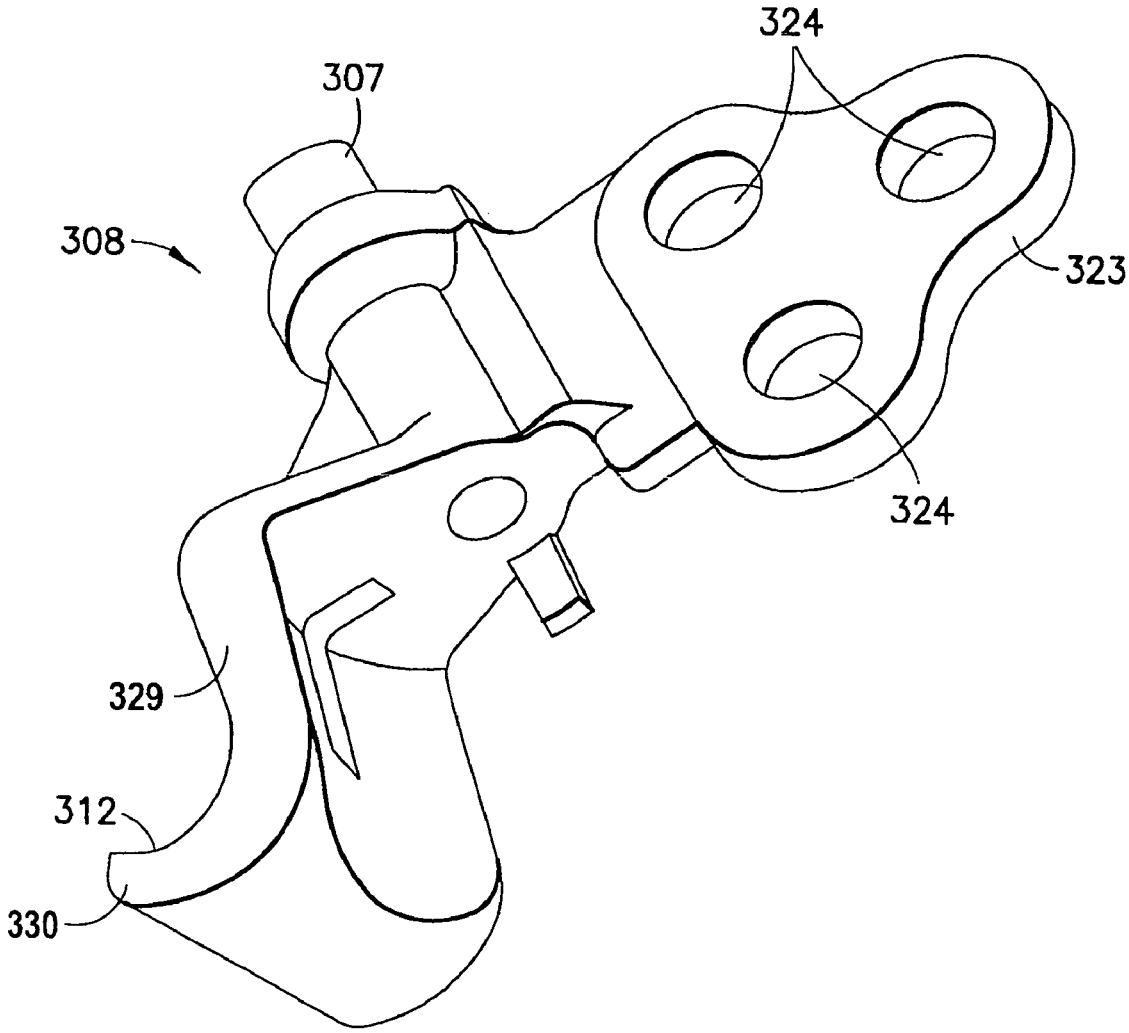
FIG. 9 is a perspective view of a female member of the electrical connector shown in FIG. 1.
Figure 10:
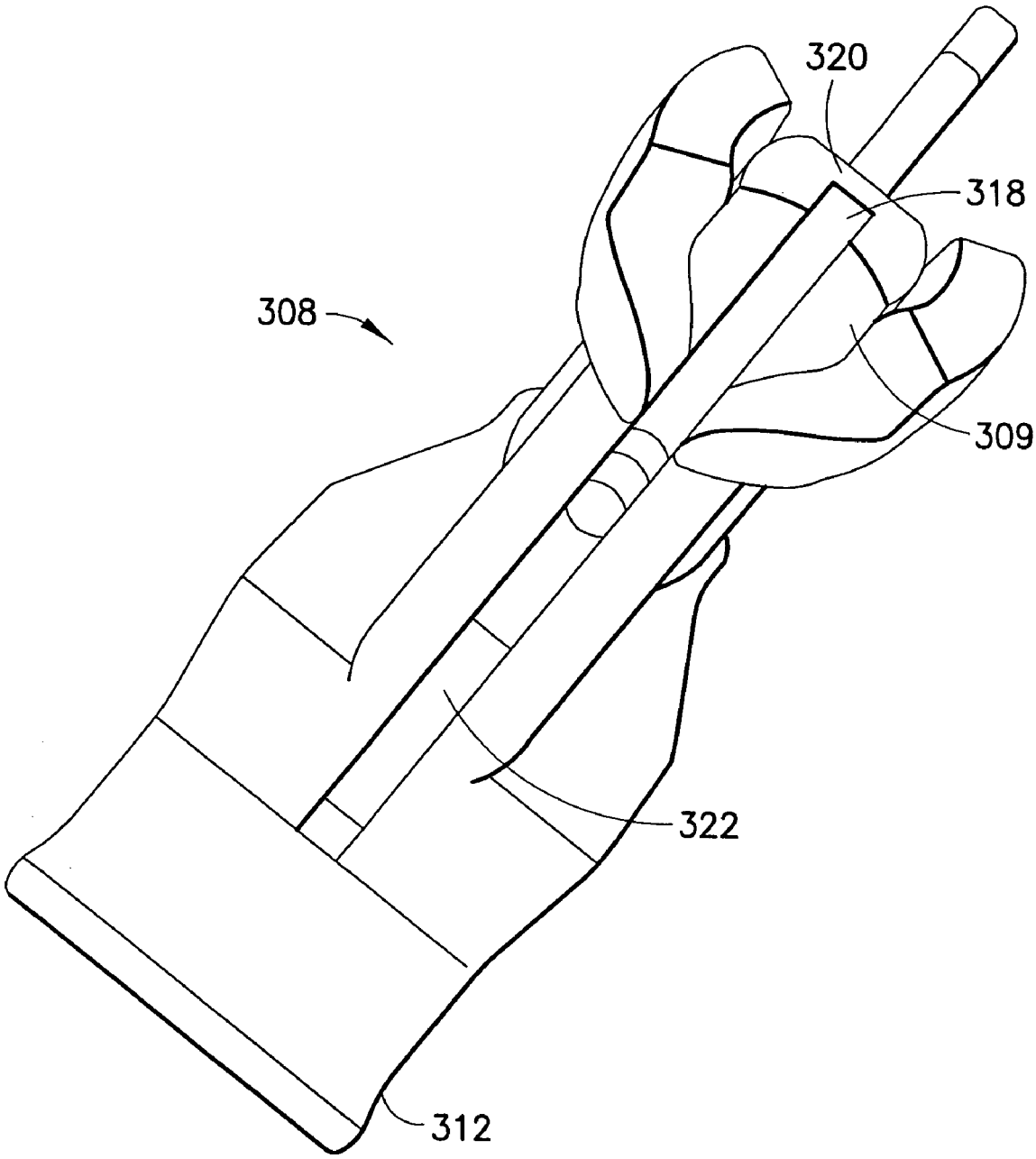
FIG. 10 is a perspective view of the female member of the electrical connector shown in FIG. 1.
Figure 11:
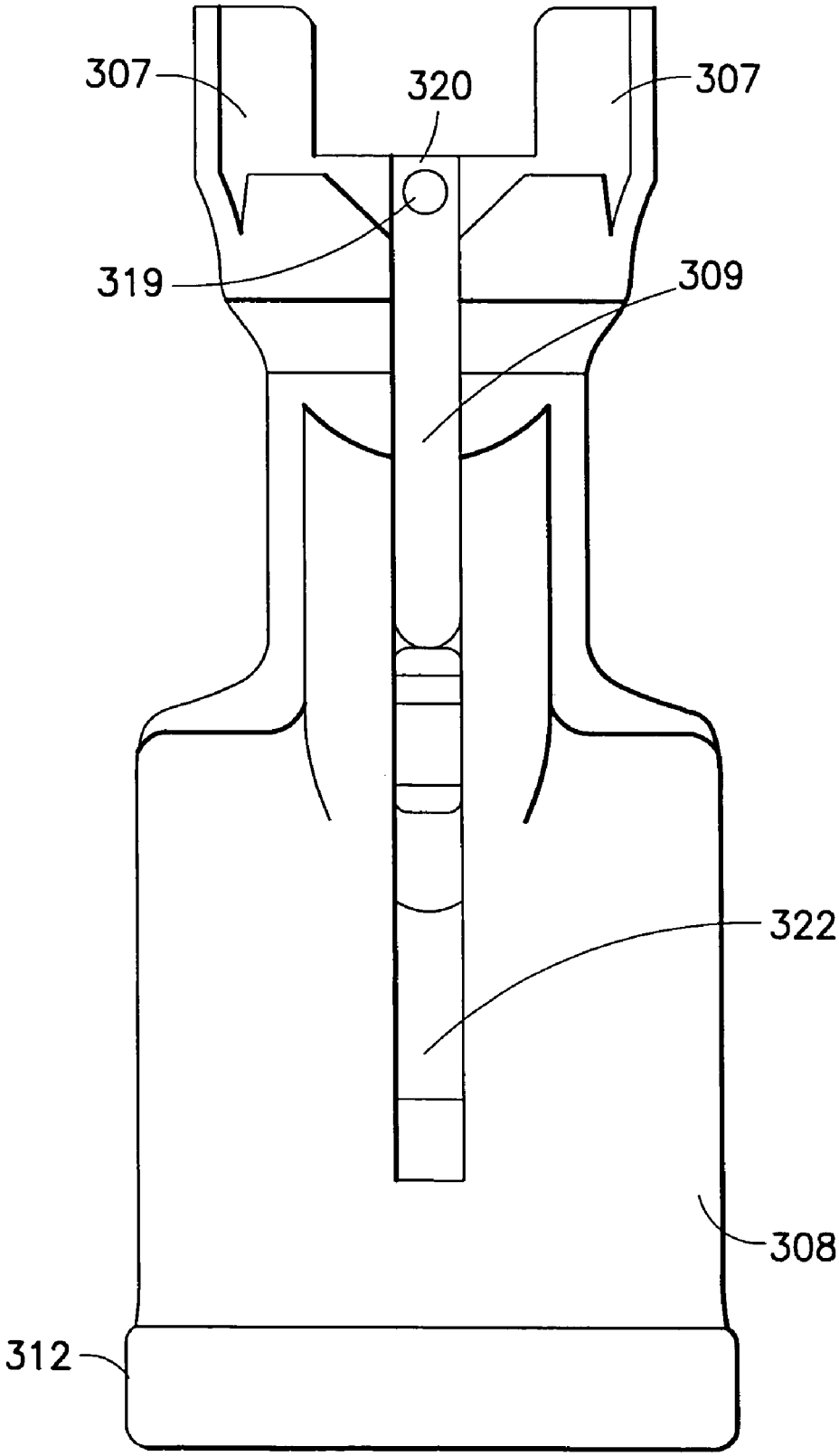
FIG. 11 is a front view of the female member of the electrical connector shown in FIG. 1.
Figure 12:
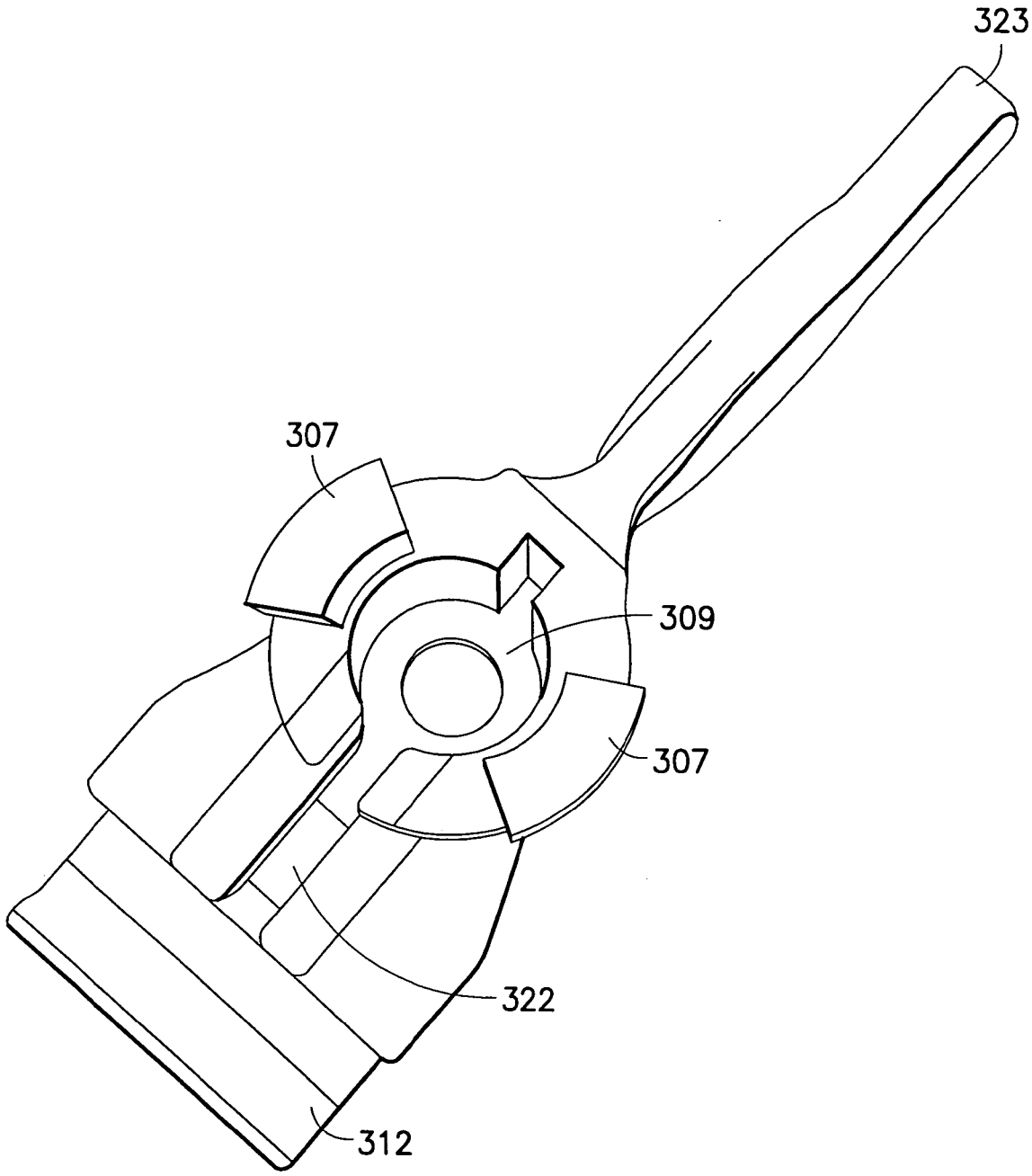
FIG. 12 is a top plan view of the female member of the electrical connector shown in FIG. 1.

Referring also to FIGS. 6-8, the male part (or male member) 301 comprises a barrel type configuration 314, a web 321, a conductor contact section (or clamp section) 311, and a top section 304. The male part 301 is preferably a one-piece member comprised of metal. The barrel type configuration (or barrel section) 314 comprises a threaded hole 302. The back 316 of the male part, along the barrel type configuration 314 has a protruding tab 317. The web (or web section) 321 extends from the front of the barrel type configuration 314.

The conductor contact section 311 has a conductor contact surface with a concave radius that is designed to accept a round type of conductor. The concave radius section 311 is about 90 degrees to the centerline 315 of the threaded hole 302. The barrel type configuration 314 and the threaded hole 302 are both on the same centerline 315. The threaded hole 302 is for accepting the eyebolt 303. However, it should be noted that an alternate embodiment, the threaded hole 302 may receive, any suitable type threaded member or fastening member.

Figure 13:
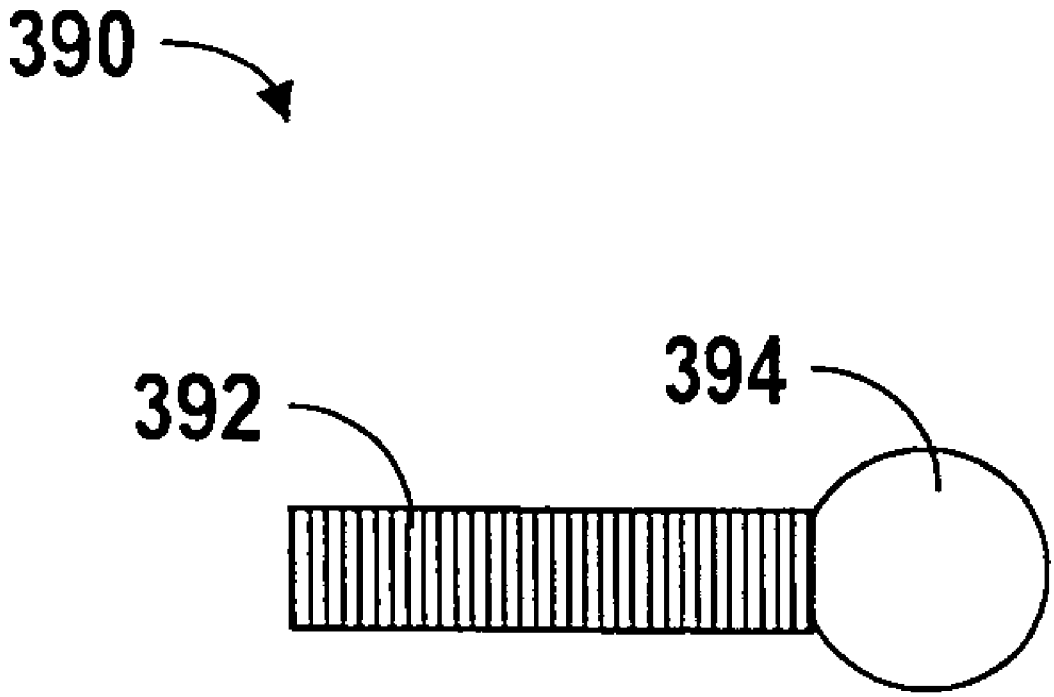
FIG. 13 PRIOR ART
FIG. 13 is a ball stud used in pad mount transformers.

The top section 304 of the male part 301 has a ball type cavity 305. This cavity 305 is for accepting a ball stud 390 (see FIG. 13) that is used in pad mount transformers. The cavity 305 has a general 'U' shape opening 310 at the top of the top section 304. This 'U' shape opening 310 is for the threaded stud portion of the ball stud to enter. The description of a ball stud 390 is basically a threaded stud 392 with a ball 394 on the end of it. The top section 304 has two openings 306 that are 380 degrees apart at opposite sides of the cavity 305. These two openings 306 are for two protruding ears 307 on the female part 308.

Referring also to FIGS. 9-12, the female part (or female member) 308 generally comprises a central section (or center section) 325 with a cavity 309, a conductor contact section (or clamp section) 312, and a spade 323. The conductor contact section 312 has a ground conductor contact surface with a concave radius to accept the ground conductor having a round type configuration. The conductor contact section 312 may comprise a generally "J" shaped configuration. The cavity 309 is sized and shaped to receive the barrel type configuration 314 of the male part 301. When the male part 301 is aligned and inserted into the cavity 309 of the female part 308, the concave radius 311 and concave radius 312 will also be aligned and form a circular cavity 313 (see FIG. 10). This circular cavity 313 will then accept a ground conductor having a general round type configuration. The concave radius 312 on the female part 308 is about 90 degrees to the centerline of the threaded shank of the eyebolt 303.

The generally "J" shaped clamp section 312 generally comprises an extending portion 329 and an end portion 330 forming the general "J" shape. The extending portion 329 extends between the end of the center section 325 comprising the opening 328 and the end portion 330. The extending portion 329 is substantially parallel to the center axis of the opening 328. The generally "J" shaped clamp section 312 extends from the end of the center section 325 in a general cantilever fashion.

The female part 308 comprises of a concave radius groove that also accepts the ground rod. When the C" shaped groove of the female part and the "C" shaped groove of the male part are attached to the ground rod, it forms a clamp onto the rod. The clamp makes the current connection. The female part has a recessed pocket "C BORE" hole that receives the male portion when assembled. A threaded end or section 326 of the eyebolt 303 is then assembled thru the female part and into the male part to make the completed assembly (best shown in FIG. 2). The fastening end or threaded end 326 of the eyebolt 303 engages the threaded opening 302 of the male member 301. An operable end or projecting end 327 of the eye bolt 303 extends from the end of the center section 325 of the female member 308. Between the threaded end 326 and the operable end 327, the eyebolt extends through an opening 328 opening at the end of the center section 325. The opening 328 may have a common centerline (or center axis) with the cavity 309 of the female member 308. The opening 328 may be a straight thru-hole providing a slidable connection between the female member 308 and the eyebolt 303. However, alternate embodiments may comprise any suitable type opening. The three-hole spade (or conductor connection section) 323 on the female part is where the three conductors are installed. The opposite end of the connector 300 is then connected to the energized unit; thus grounding it out.

As the male part 301 travels into the cavity 309 of the female part 308 the ears 307 protrude into the openings 306 and apply more pressure onto the ball stud 390. The protruding tab 317 rides inside of a slot 318 inside of cavity 309. After the male part 301 is fully inserted into cavity 309, and the tab 317 into slot 318, a pin 319 (see FIG. 2) is inserted at the end 320 of the slot 318 to prevent the male part 301 from separating from the female part 308. The web 321 of the male part 301 helps guide it when it enters the female part 308. Cavity 309 in the female part 308 has an open slot 322 that acts as a guide for the web 321. The female part 308 has a spade 323 that contains three holes 324. These holes 324 are for mounting the grounding accessory cables to. The three holes 324 are arranged in a generally triangular orientation. The spade 323 is at a 90 degree angle to the centerline of the concave radius 312 in the female part 308.

The connector 300 can also comprise miscellaneous items comprising of a split lock washer and two roll pins.

The connector 300 can provide a 'J' clamping connection. In one type of embodiment, the confinement, as far as one side of the clamp, does not protrude beyond about one inch from the grounding bar. The generally close proximity of the eyebolt 303 and the "J" shaped clamping section 312 provides significant advantages over conventional grounding connectors. Conventional configurations generally have the eyebolt (or threaded member) in a reverse orientation wherein the eyebolt threads into the female part. With the disclosed configuration, the threaded member 303 engages the threaded opening 302 in the male member 301. This provides for an operable end of the threaded member 303 to be adjacent to the "J" shaped clamp section 312. Having the eyebolt 303 close to the clamp section 312 allows for a compact connector configuration which does not interfere with a power supply door. Therefore the disclosed configuration allows the power supply doors to be closed after the grounding connector 300 is installed. The grounding connection for the three leads provided by the holes 324 is in a triangular configuration. The connector is universal in that it can be fasten to a bar or a ball stud. The connector has a cavity that allows it to fit into the end of a hot stick. This cavity is at the end of the center section 325 of the female member 308 between the "J" shaped clamp section 312 and the conductor connection section 323. This allows for a hot stick to be fitted over the operable end of the eyebolt and between the "J" shaped clamp section 312 and the conductor connection section 323. In other words, the open area (or cavity) between the "J" shaped clamp section 312 and the conductor connection section 323 is configured to accommodate a lineman's hot stick. Guiding of the two components when they are assembled together is provided as a novel aspect of the invention. The clamping technique of the ball stud and how it is held in place is also a novel aspect of the invention.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. A grounding connector for a power supply unit comprising:

a female member comprising a first clamp section, a conductor connection section, and a center section between the first clamp section and the conductor connection section, wherein the center section comprises a first end and an opposite second end, wherein the first clamp section extends from the first end;

a male member at the second end of the center section, wherein the male member comprises a second clamp section opposite the first clamp section; and a fastening member extending through the center section, wherein an operable end of the fastening member extends from the first end, and wherein the first clamp section and the operable end are configured to be laterally adjacent one another and adapted to allow for a door of the power supply unit to close after installation of the connector therein.

2. The grounding connector of claim 1 wherein the first clamp section is configured to be connected a ground rod of the power supply unit, and wherein the conductor connection section is configured to be connected to grounding accessory cables.

3. The grounding connector of claim 1 wherein the first clamp section extends from the center section at a lateral distance of about 1 inch or less.

4. The grounding connector of claim 1 wherein the first clamp section and the operable end are proximately spaced at a distance for preventing interference with the door of the power supply unit.

5. The grounding connector of claim 1 wherein the first clamp section is configured to be connected a ground rod of the power supply unit, wherein the conductor connection section is configured to be connected to grounding accessory cables, and wherein the first clamp section extends from the center section a lateral distance of about 1 inch or less.

6. The grounding connector of claim 5 wherein the first clamp section and the operable end are proximately spaced at a distance for preventing interference with the door of the power supply unit.

7. The grounding connector of claim 6 wherein a portion of the first clamp section extends substantially parallel to the fastening member.

8. The grounding connector of claim 1 wherein the first clamp section comprises a generally "J" shaped configuration, and wherein the generally "J" shaped configuration extends from the first end in a general cantilever fashion.

9. The grounding connector of claim 1 wherein the female member is configured to accommodate a hot stick at the operable end of the fastening member.

10. A grounding connector for a power supply unit comprising:

a female member comprising a first clamp section, a conductor connection section, and a center section between the first clamp section and the conductor connection section, wherein the center section comprises a first end and an opposite second end, wherein the first clamp section extends from the first end;

a male member at the second end of the center section, wherein the male member comprises a second clamp section opposite the first clamp section, and wherein the first clamp section and the second clamp section form a clamp configured to receive a ground rod; and a fastening member extending through the center section, wherein an operable end of the fastening member extends from the first end, and wherein the clamp and the operable end are proximately spaced at a distance for preventing interference with a door of the power supply unit when the ground rod is received by the clamp section.

11. The grounding connector of claim 10 wherein the clamp is configured to receive the ground rod inside the power supply unit, and wherein the conductor connection section is configured to be connected to grounding accessory cables.

12. The grounding connector of claim 10 wherein the second clamp section extends beyond the first end of the center section.

13. The grounding connector of claim 10 wherein the clamp is spaced from the center section at a lateral distance of about 1 inch or less.

14. The grounding connector of claim 10 wherein the fastening member comprises a threaded eyebolt, and wherein a looped end of the eyebolt is proximate the clamp.

15. The grounding connector of claim 14 wherein the looped end is configured to be operable by a utility lineman.

16. The grounding connector of claim 10 wherein a portion of the first clamp section extends substantially parallel to the fastening member.

17. The grounding connector of claim 10 wherein the first clamp section comprises a generally "J" shaped configuration, and wherein the generally "J" shaped configuration extends from the first end in a general cantilever fashion.

18. A method of manufacturing a grounding connector for a power supply unit comprising:

providing a female member comprising a first clamp section, a conductor connection section, and a center section between the first clamp section and the conductor connection section, wherein the center section comprises a first end and an opposite second end, wherein the first clamp section extends from the first end;

providing a male member comprising a second clamp section configured to be aligned opposite the first clamp section; and providing a fastening member configured to engage with the male member, wherein an operable end of the fastening member extends from the first end when the fastening member is engaged with the male member, and wherein the first clamp section and the operable end are configured to be laterally adjacent one another and adapted to allow for a door of the power supply unit to close after installation of the connector therein.

19. The method of claim 18 wherein the providing of the male member further comprises providing the male member wherein a portion of the male member is configured to be received by the opposite second end, and wherein the second clamp section extends beyond the first end when the fastening member is engaged with the male member.

20. The method of claim 18 wherein the providing of the fastening member further comprises providing the fastening member wherein the first clamp section and the second clamp section form a clamp configured to receive a ground rod of the power supply unit, and wherein the clamp and the operable end are proximately spaced at a distance for preventing interference with the door of the power supply unit.

* * * * *